United States Patent [19]

Berry, Jr.

[11] 4,089,100

[45] May 16, 1978

[54] METHOD AND APPARATUS FOR INSTALLING A CUTTERHEAD UPON A BOX HOLE BORING MACHINE

[75] Inventor: Robert W. Berry, Jr., Brea, Calif.

[73] Assignee: Smith International, Inc., Newport Beach, Calif.

[21] Appl. No.: 602,775

[22] Filed: Aug. 7, 1975

[51] Int. Cl.[2] ..... B23P 19/04; B60P 1/02

[52] U.S. Cl. ..... 29/428; 175/85; 214/512

[58] Field of Search ..... 175/85; 166/79; 214/1 D, 1 H, 1 MS, 1 P, 38 C, 38 CC, 512; 280/79.1 A; 29/428

[56] References Cited

U.S. PATENT DOCUMENTS

| | | | |
|---|---|---|---|
| 3,090,514 | 5/1963 | Black, Sr. et al. | 214/512 |
| 3,099,323 | 7/1963 | Kelley | 175/85 |
| 3,357,582 | 12/1967 | Wittek | 214/38 C |
| 3,460,638 | 8/1969 | Millsapps, Jr. | 175/85 |
| 3,613,906 | 10/1971 | Deyo et al. | 175/85 X |
| 3,695,363 | 10/1972 | Kelley, Jr. | 175/85 X |
| 3,902,561 | 9/1975 | Friberg et al. | 175/85 X |

*Primary Examiner*—C.W. Lanham
*Assistant Examiner*—D. M. Gurley

[57] ABSTRACT

In order to install a heavy cutterhead upon a box hole boring machine, within the confined working space available in underground mining operations, the cutterhead is placed upon a wheeled dolly having a central opening through which the attachment stem of the cutterhead depends downwardly, a temporary bridge including a pair of rails is rested upon the top of the machine frame, and the dolly with cutterhead supported thereon is moved along the bridge to a position where the cutterhead can be attached to the machine. The vertical drive of the machine is then utilized to lift the cutterhead, and the dolly and temporary bridge are removed.

8 Claims, 29 Drawing Figures

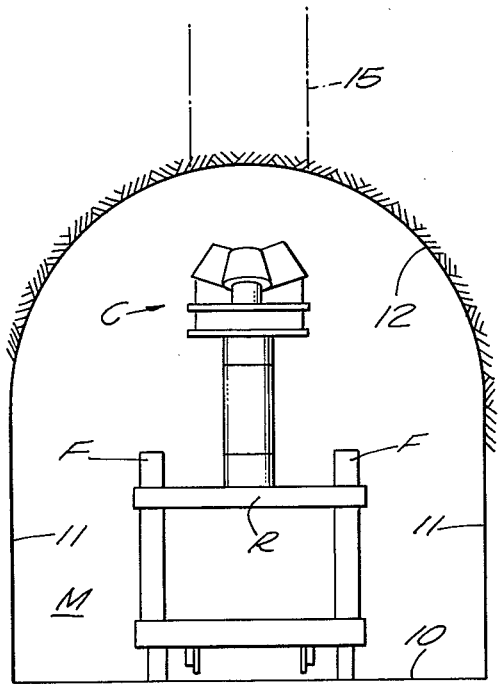
FIG. 1a.
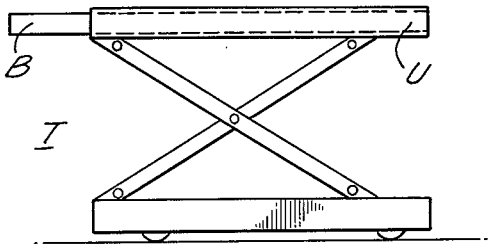
FIG. 1b.
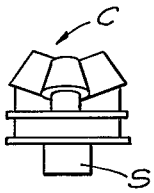
FIG. 1c.
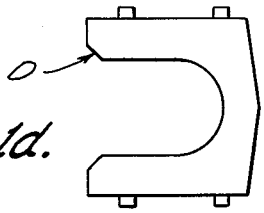
FIG. 1d.
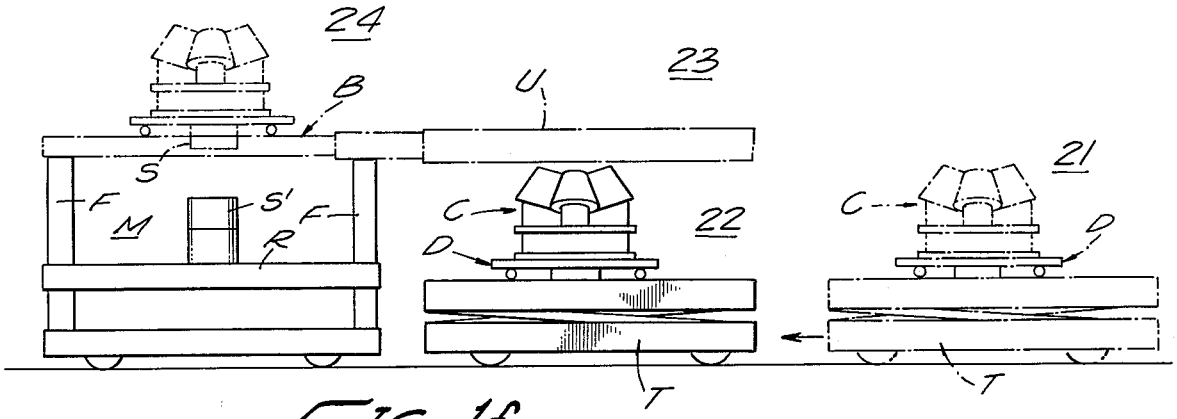
FIG. 1f
FIG. 1e
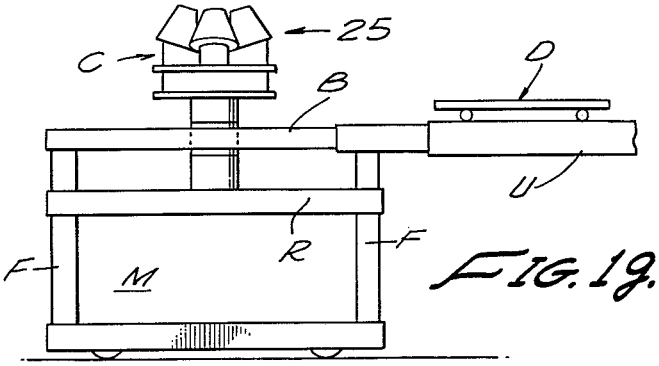
FIG. 1g.
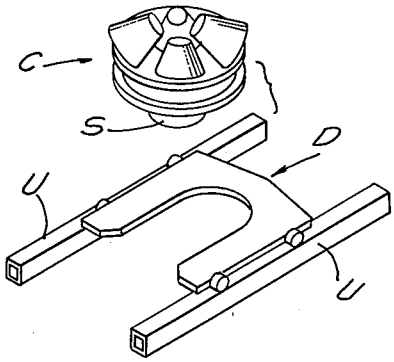

18
18
56
63
T
U
53
51
50
52
58
D
62
61
67
71
F
M
R
C
39
38
36
31d
30
34
32
S
S'
45
37
35
31c
75
68
66
70

METHOD AND APPARATUS FOR INSTALLING A CUTTERHEAD UPON A BOX HOLE BORING MACHINE

BACKGROUND OF THE INVENTION

Box hole boring machines are used in the underground drift of a mine for robbing ore material which is located in a substantially vertical direction above the machine. A cutterhead is attached to the upper end of an extensible drive shaft or drill stem, and a hole is cut which may be precisely vertical or which may be inclined at an angle of 10, 20 or more degrees from the vertical.

An effective machine of this type may utilize a cutterhead which weighs several tons. The cutterhead is generally transported to the mine, and attached to the machine, as a single unitary structure. Since the cutterhead operates at elevations above the machine itself, the attachment of the cutterhead to the machine in the first instance requires lifting the cutterhead upward from the floor of the drift, moving it horizontally over the machine, and aligning it correctly with the machine so that attachment is possible.

Available working space within means is inherently very limited. A conventional crane cannot be used for attaching the cutterhead to the boring machine, because the crane would be much too large to be received in the mine drift. Likewise, a conventional fork lift machine is too large to fit into the available space.

The conventional practice, therefore, has been to make a custom installation of fastening devices into the rock walls or ceiling of the tunnel, and then attach a lifting sling to these fastening devices. This previously utilized procedure for installing the cutterhead has been slow, cumbersome, and unduly expensive.

The object and purpose of the present invention, therefore, is to provide an economical and efficient method and apparatus for handling and aligning a heavy cutterhead, and attaching it to its associated box hole boring machine, within the limited working space of a mine drift or tunnel.

SUMMARY OF THE INVENTION

According to the present invention a temporary bridge is positioned with one of its ends resting on top of the frame of the vertical boring machine; the cutterhead is placed upon a special wheeled dolly; and the dolly and cutterhead are moved along the bridge until the cutterhead is aligned in its proper position relative to the machine for purposes of attachment.

More specifically, the bridge includes a pair of rails, and the dolly wheels ride upon the rails. The dolly has a central opening through its bed or frame, and when the cutterhead rests upon the dolly the attachment stem of the cutterhead projects downwardly through that central opening. When the cutterhead is aligned to the machine a vertically movable part of the machine is raised into engagement with and secured to the attachment stem of the cutterhead. The vertical power drive of the machine is utilized to lift the cutterhead from the dolly and the temporary bridge may be removed from the machine.

In its preferred form the dolly has a frame or bed which is of a generally U-shaped configuration in the horizontal plane, being open at its forward end portion as well as in its center portion. It is therefore possible, after the cutterhead has been secured and raised, to retract the dolly along the bridge rails without any necessity for disassembly of the dolly.

Another feature of the present invention is the provision of a transport car into which the temporary bridge rails are incorporated. The transport car has a lower bed, an upper bed, and a scissors lift mechanism which supports the upper bed at an adjustable elevation above the lower bed. The upper bed is equipped with fixed rails for supporting the dolly. The temporary bridge rails are telescopically contained within the fixed rails. The transport car is preferably kept in its lowered or compact position while transporting a cutterhead through the mine tunnel to the boring machine location. The scissors lift is then used to raise the upper bed to about the same elevation as the top of the boring machine frame. The bridge rails are then extended and their projecting ends are removably secured to the machine frame. The dolly and cutterhead are then moved along the bridge rails, as previously described.

It is quite significant that, according to the invention, the bridge rails are supported on both of their ends while the load is being transferred. The temporary bridge has a cantilever support only until the projecting ends of the rails can be supported upon and secured to the machine frame. When the dolly and cutterhead have been moved along the rails to the aligned position of the cutterhead, the entire weight load of the dolly and cutterhead is indirectly supported from the machine frame.

According to the method of installation of the cutterhead as provided by the present invention, much of the procedure is easily and quickly accomplished by hand labor. A series of individual steps of the process are accomplished by power driven means, while the various alignment procedures and the control of the power driven means, are accomplished by hand.

More specifically, a power drive is used to drive the scissors lift for raising the upper bed (fixed rails) of the transport car. Extension of the bridge rails is also aided by a power drive. And, the same winch used to extend the bridge rails is later used to propel the dolly, with cutterhead thereon, across the bridge to its destination.

DRAWING SUMMARY

FIGS. 1*a* through 1*g* are schematic views illustrating the method and apparatus of the invention;

SCHEMATIC ILLUSTRATIONS

Figure 2:
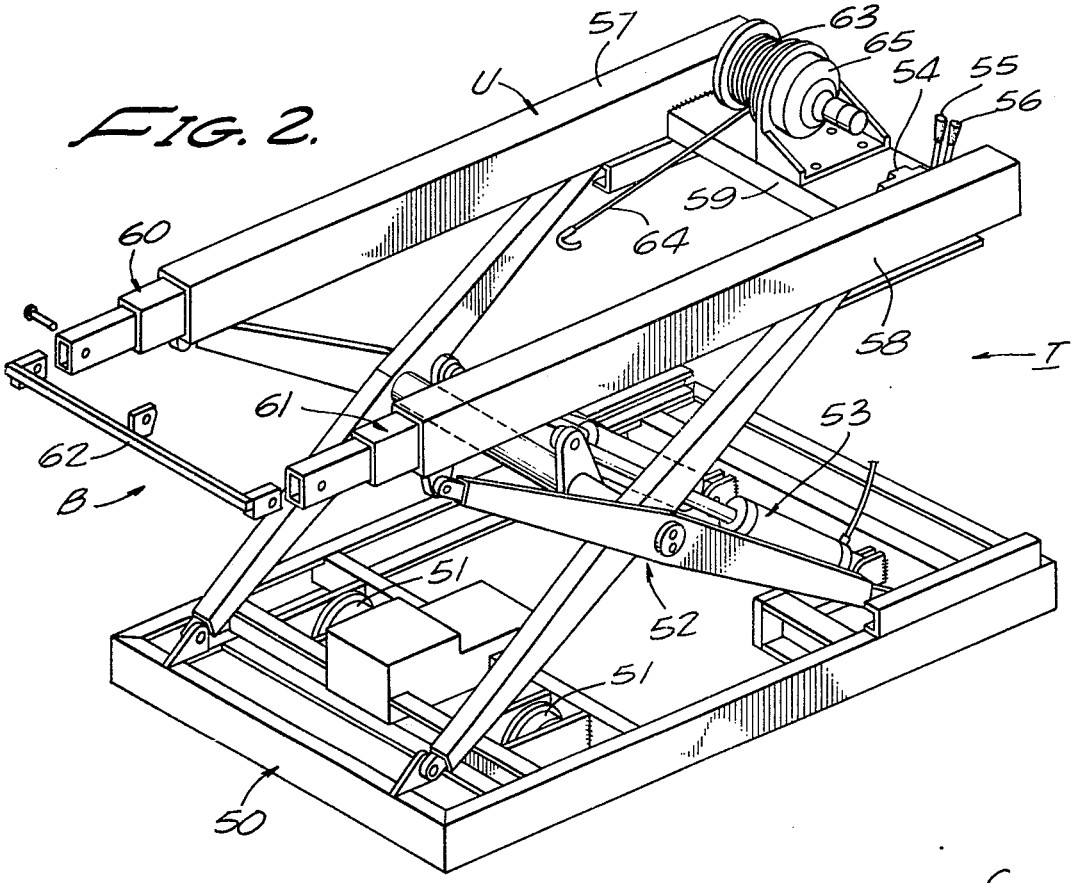
FIG. 2 is a perspective view of the cutterhead transport car, without the dolly.
Figure 3:
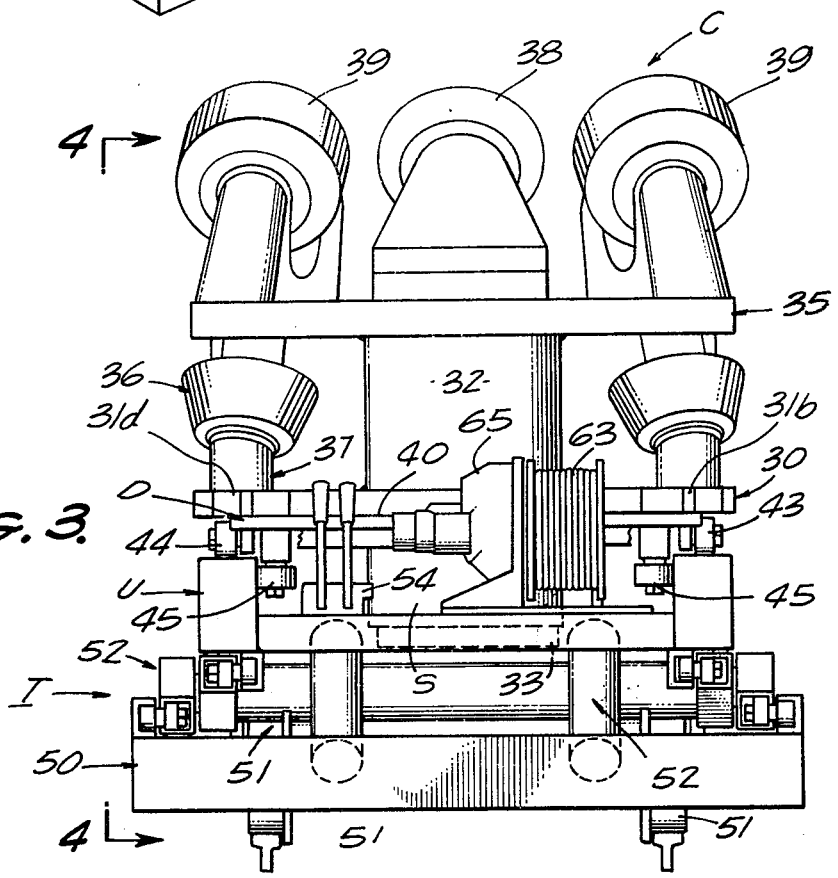
FIG. 3 is a rear end elevation view of the cutterhead transport car when in its collapsed condition, and supporting a cutterhead thereon.
Figure 4:
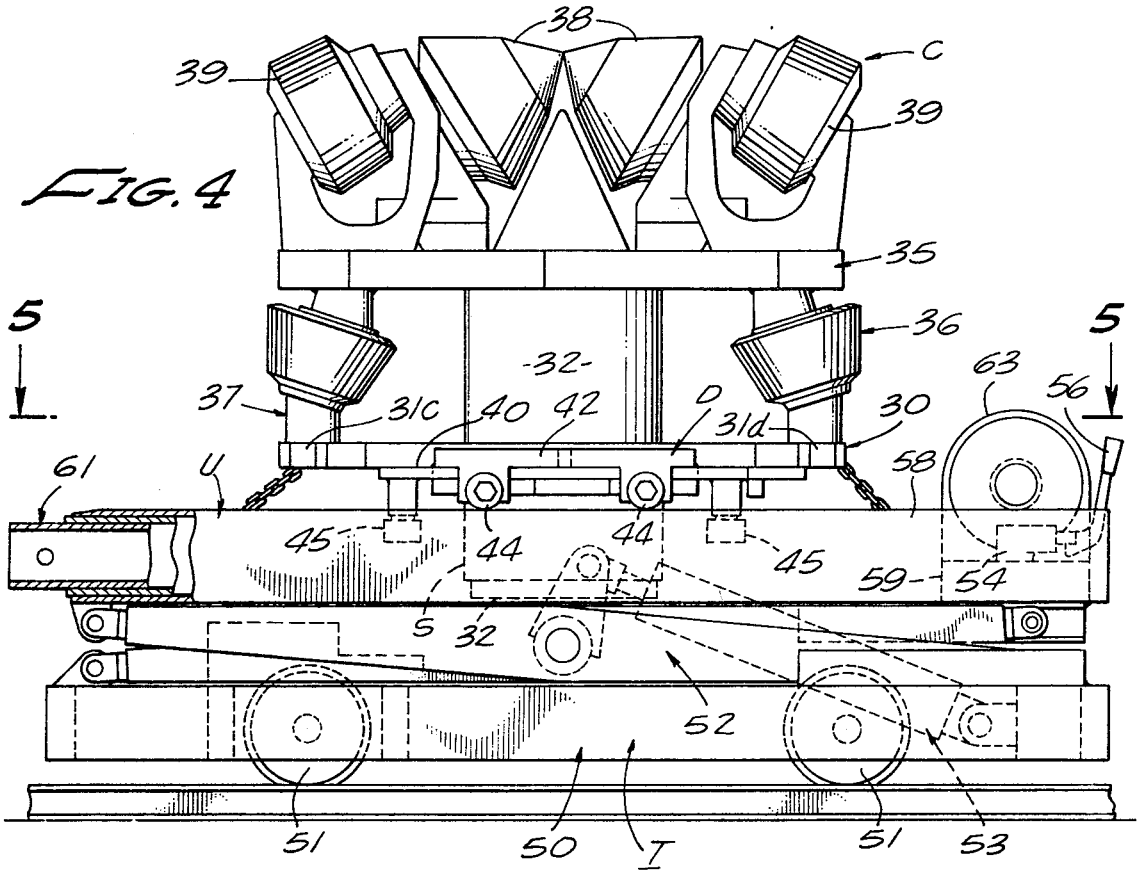
FIG. 4 is a side elevation view of the apparatus of FIG. 3, taken from the lefthand side on line 4—4 thereof.

In drawing FIGS. 1(*a*) through 1(*g*) the method and apparatus of the present invention are schematically illustrated.

In FIG. 1(*a*) the numeral 10 identifies the floor of the drift or tunnel which also has side walls 11 and a curved roof or ceiling 12. The box hole or raise bore 15 that is proposed to be drilled above roof 12 by the machine M is shown in dotted lines.

Box hole boring machine M is seen in an end view in FIG. 1(*a*) and in side views in FIGS. 1(*f*) and 1(*g*). Its main frame F includes four vertical corner posts. Its rotary table R is shown in a relatively lowered position in FIG. 1(*f*) and in a relatively raised position in FIGS. 1(*a*) and 1(*g*). Cutterhead C shown in a side elevation view in FIG. 1(*c*) has a downwardly extending central attachment stem S.

Transport car T is shown in FIG. 1(*b*) in a side elevation view in which its upper bed U is in the raised position and the temporary bridge rails B are partially extended.

FIG. 1(*d*) shows a top plan view of dolly D.

FIG. 1(*e*) is a partially exploded perspective view showing the fixed rails of upper bed U of the transport car with dolly D resting thereupon. Cutterhead C with its stem S is shown above the dolly.

The novel method or process of the present invention is shown in outline form in FIGS. 1(*f*) and 1(*g*). In the initial position 21 shown in dotted lines transport car T is somewhat removed from machine M and the upper bed U thereof is in its lower position. Cutterhead C is placed upon and attached to the dolly D and the dolly in turn is supported upon the bed of the transport car. In position 22 the transport car with cutterhead thereon has been moved to a position adjacent the box hole boring machine.

Dotted lines 23 illustrate the raised position of upper bed U, and while not specifically shown it will be understood that when the bed is first raised the cutterhead is still directly supported above it. Temporary bridge rails B (dotted lines) are extended horizontally outward to form a bridge which extends from the bed U to and upon the upper ends of the frame posts F. After the bridge rails are fully extended, the dolly with cutterhead thereon is then moved along the bridge until it occupies position 24, also shown by dotted lines in FIG. 1(*f*).

The next step is to raise rotary table R of the boring machine. When this is done a section of drill stem S' supported on the rotary table supportingly engages the undersurface of stem S of the cutterhead. The cutterhead is then lifted free of the bridge rails B to position 25 as shown in FIG. 1(*g*). Dolly D is then drawn back along the bridge and onto the upper bed U of the transport car. Although not specifically shown in the schematic drawings, the bridge rails B are then retracted within the upper bed U so that they will not interfere with operation of the box hole boring machine M.

It will be noted that dolly D has a central opening through which central stem S extends when cutterhead C is being transported thereon.

For convenient reference the main parts of the apparatus and their identifying letter symbols are listed as follows:

C — Cutterhead
S — Attachment stem of the cutterhead
D — Dolly
T — Transport car
U — Upper bed of transport car (fixed rails)
B — Temporary bridge (extensible rails)
M — Box hole boring machine
F — Frame of the boring machine
R — Rotary table of the boring machine
S' — Drill stem on rotary table

DETAILED DESCRIPTION

The various parts of the apparatus will first be described in some detail, and thereafter the method of use or operation will be described. The main parts of the apparatus are cutterhead C, dolly D, transport car T, and machine M.

Cutterhead C is best seen in FIGS. 3 through 7 and 14. It includes a horizontal base plate 30 and a horizontal top plate 35. A set of four side rollers 36 are carried at the sides of the cutterhead, each being journaled upon a vertical support piece 37 which has its lower end anchored in a corner of base plate 30 while its upper end is attached to the lower surface of top plate 35. A set of end face rollers 38 are mounted above the top plate 35 for rolling engagement with the end face of the hole bore, while a set of gauge or corner rollers 39 are mounted about the top plate 35 at its outer periphery for initially determining the gauge of the bore that is being cut.

Figure 5:
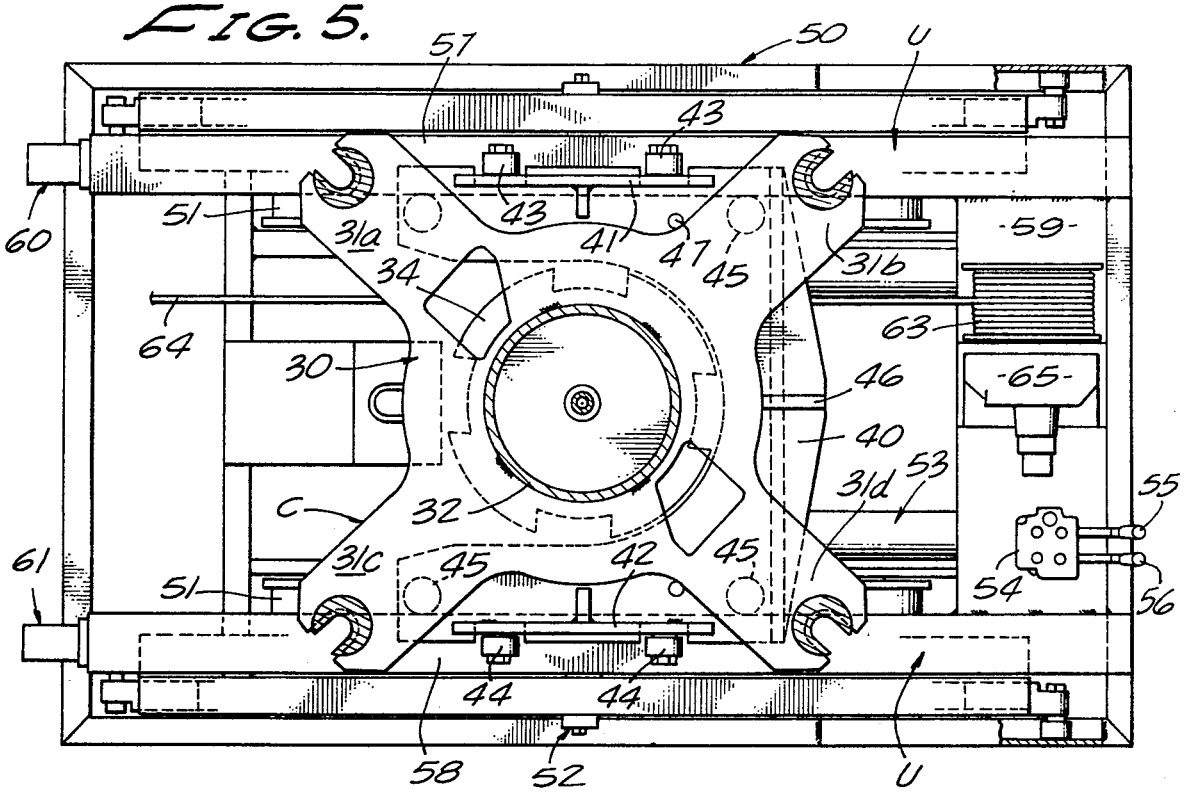
FIG. 5 is a plan view, partially in cross-section, taken on line 5—5 of FIG. 4.
Figure 6:
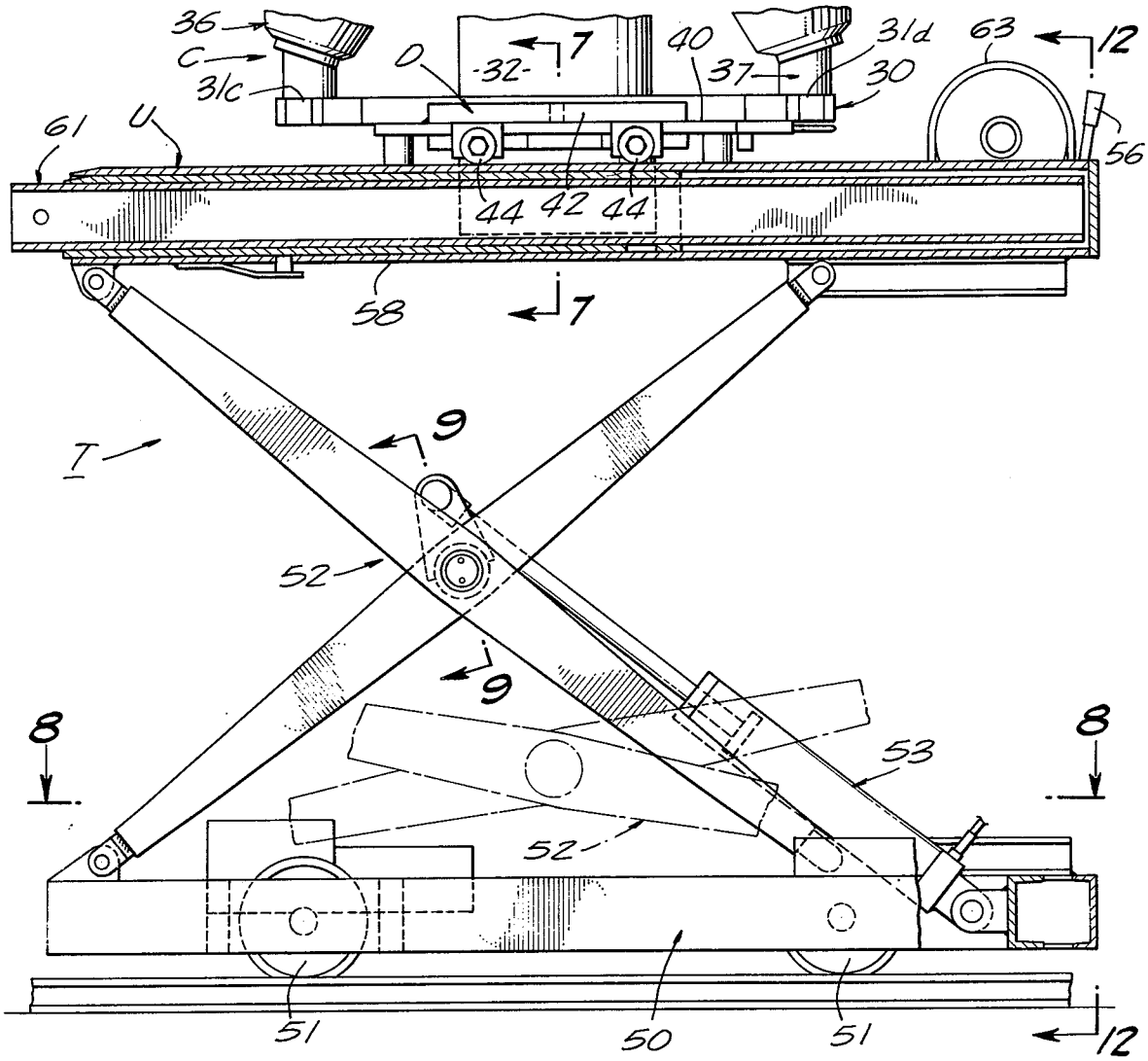
FIG. 6 is a side elevation view, partially in cross-section, of the cutterhead transport car in its raised or load transferring position, with a cutterhead supported thereon.
Figure 7:
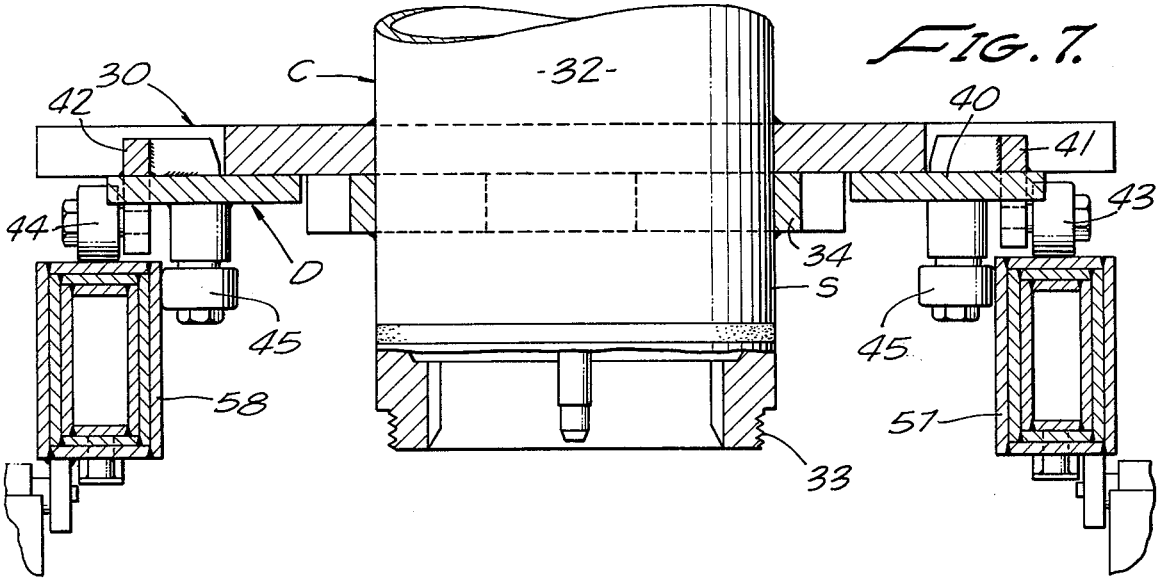
FIG. 7 is a fragmentary cross-sectional view taken on the line 7—7 of FIG. 6.
Figure 8:
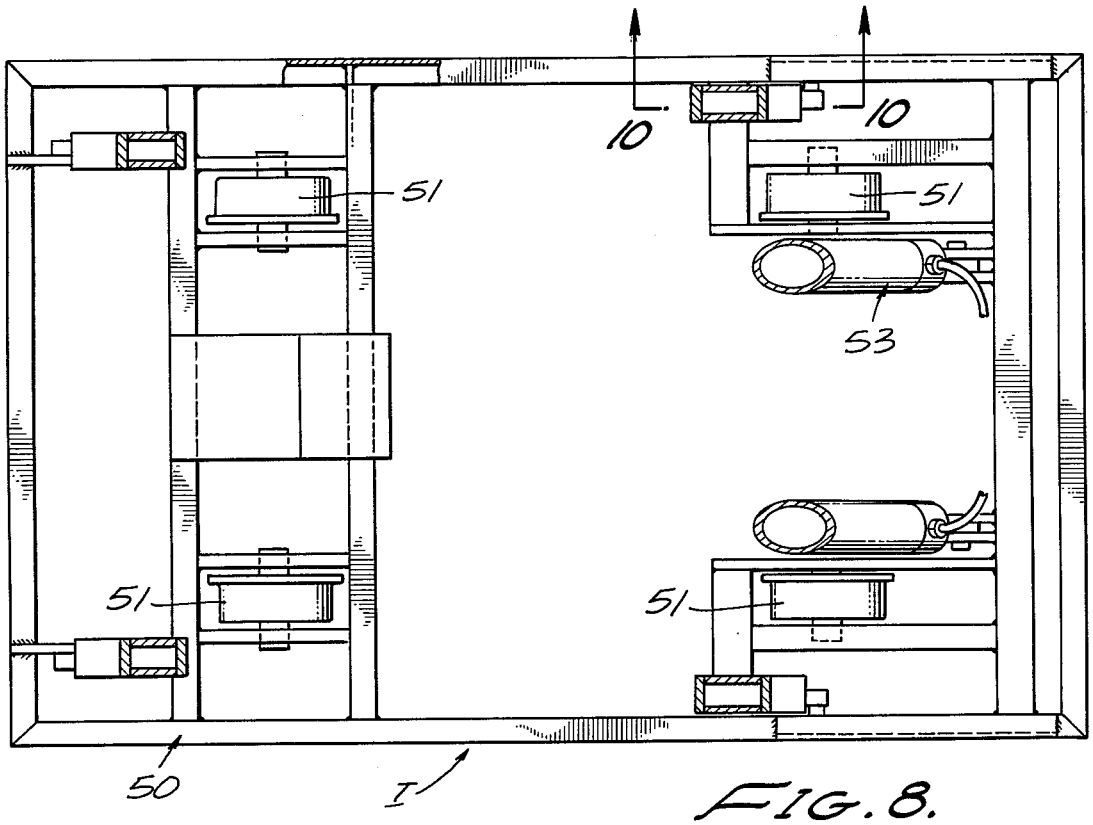
FIG. 8 is a plan view, partially in cross-section, taken on line 8—8 of FIG. 6.
Figure 9:
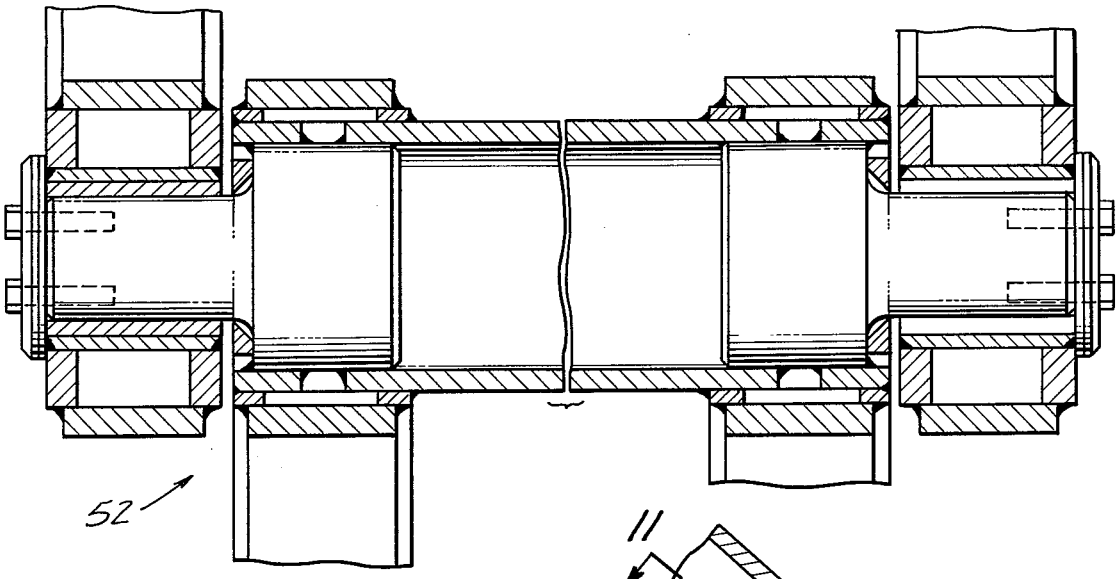
FIG. 9 is a fragmentary cross-sectional view taken on line 9—9 of FIG. 6.
Figure 10:
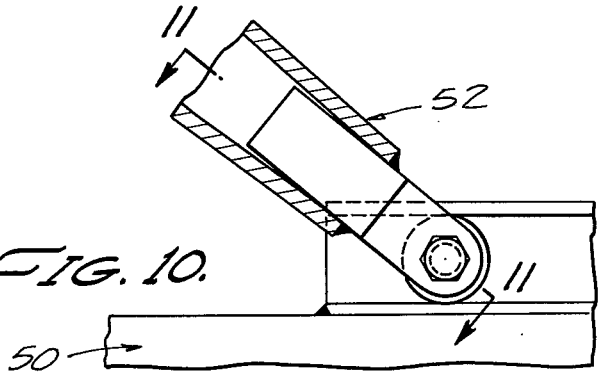
FIG. 10 is a fragmentary cross-sectional view taken on the line 10—10 of FIG. 8.
Figure 12:
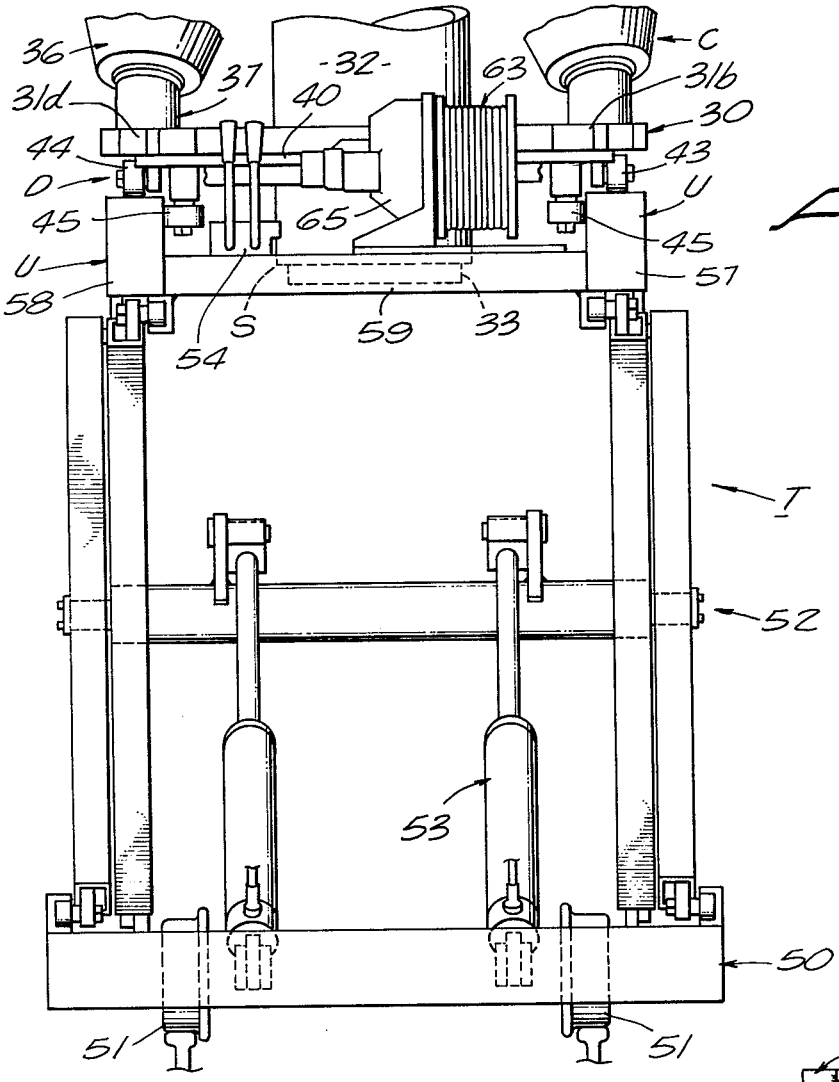
FIG. 12 is a rear end elevation view taken on the line 12—12 of FIG. 6.
Figure 11:
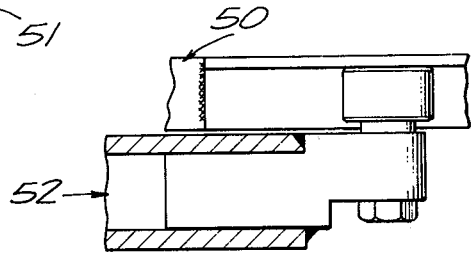
FIG. 11 is a fragmentary cross-sectional view taken on the line 11—11 of FIG. 10.

Of particular interest is the shape of bottom plate 30 as shown in FIG. 5. This plate has a set of four legs 31*a*, 31*b*, 31*c*, 31*d* which extend horizontally outwardly at 90° intervals in which the lower ends of the supports 37 are received. Plate 30 has a central opening within which a central tube 32 is secured to the underside of upper plate 35, while the lower end of tube 32 extends downwardly a considerable distance beneath the base plate 30 and provides the attachment stem S of the cutterhead. The threads of stem S are designated by numeral 33. A flange plate 34, shown in dotted lines in FIG. 5 and in a side elevation view in FIG. 7, surrounds the center tube 32 immediately beneath the bottom plate 30. Flange plate 34 has recesses around its periphery which are utilized in conjunction with the hair pin assembly of machine M as will be later described.

Figure 13:
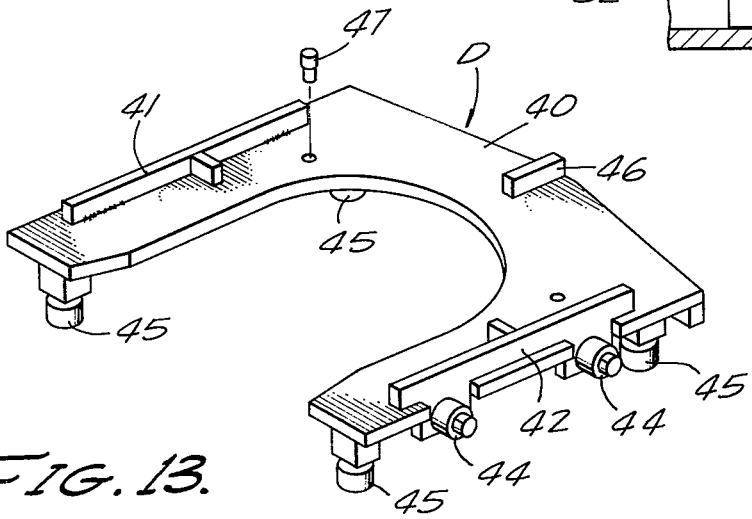
FIG. 13 is a perspective view of the dolly when detached from the transport car, and without the cutterhead thereon.

Dolly D has a flat horizontal bed 40 of generally U-shaped configuration with the central portion being open and the forward part thereof also being open. Vertical side pieces 41, 42 are attached to respective lateral sides of the bed 40. A pair of wheels or rollers 43 are mounted on the side piece 41 for supporting the dolly on one rail of a rail pair, while a pair of wheels or rollers 44 are supported on the other side piece 42 for the same purpose. Each side of the bed 40 also has supported underneath it a pair of rollers 45 which are mounted upon vertical axes of rotation, the purpose of these rollers being to establish the lateral position of the dolly by engaging the inside walls of the rail pair upon which the dolly is to travel. A rear piece 46 is attached to the central upper surface of bed 40. A pair of removable pins 47 (see FIG. 13) may be secured to the bed 30 when needed during the use of the dolly as will be later described.

Transport car T, FIG. 2, will now be described. The transport car has a lower bed 50 supported on wheels 51. The upper bed U can be raised or lowered relative to the lower bed. Upper bed U includes, specifically, a pair of parallel fixed rails 57, 58, as well as a laterally extending rail support 59 which maintains the rails 57, 58 in their properly spaced relationship. Rails 57, 58 are made hollow because they house the telescoping tubes 60, 61, respectively, when the tubes are in their retracted position.

Upper bed U is supported from the lower bed 50 by means of a conventional scissors lift mechanism 52. A pair of hydraulic drive cylinders 53 provide the power for raising or lowering the lift mechanism. A control panel 54 supports a pair of control levers or handles, including a control handle 55 for actuating the drive cylinders 53 and another control handle 56 for controlling the operation of the winch motor.

The temporary rail bridge B not only includes the pair of telescoping tubes or rails 60, 61, but it also includes a cross-piece 62 which can be removably attached to the outermost ends of the tubes. A winch 63 carries a cable 64 and is driven by a winch motor 65 and this assembly provides a manually controlled source of power for horizontal movements as contrasted with the vertical movements which are powered by drive cylinders 53 under the control of handle 55.

Thus the winch motor 65 controlled by handle 56 drives the winch 63 for either paying out the cable 64 or pulling it in, as required. One purpose of this horizontal power drive is to extend the extensible rails or tubes 60, 61 without requiring excessive manual effort by the operator. Another purpose is to provide power for retracting the extensible rails or tubes. Still another purpose of this power means is to propel the dolly, with cutterhead thereon, across the temporary bridge when it is to be installed upon machine M. It may subsequently, in a reverse procedure, be used for removing the cutterhead.

Figure 14:
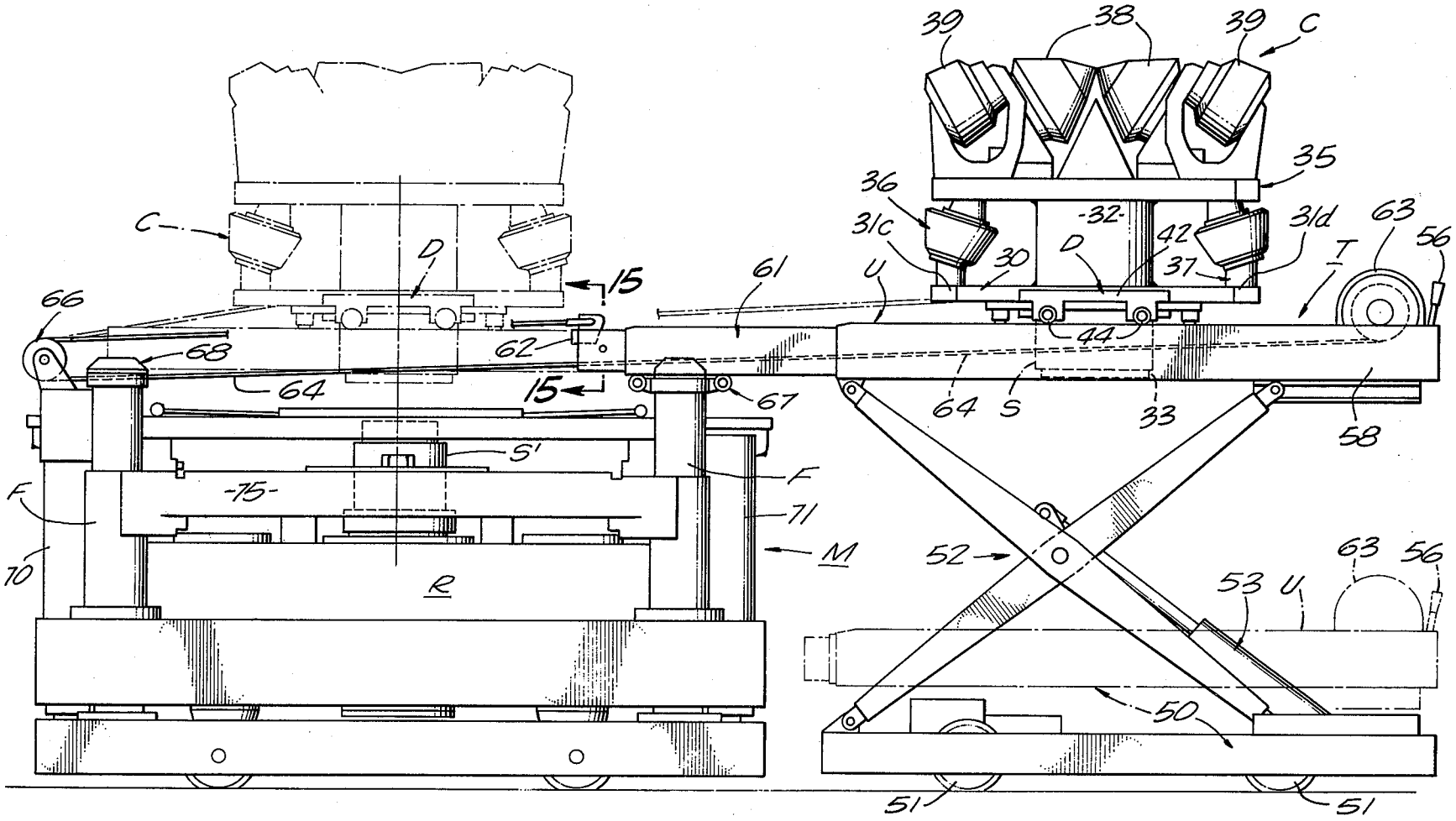
FIG. 14 is a side elevation view of the box hole machine and of the cutterhead transport car, illustrating the operation of transferring the cutterhead from the transport car to the machine.

Extensible rails 60, 61 when fully extended will reach to and upon the frame F of machine M. A pair of detachable rail guides 67 are placed upon the near pair of the frame tubes F, FIGS. 14 and 17. Each of the rail guides includes a cap which fits over the top of the corresponding post, a channel member which is upwardly disposed and is permanently fastened to the cap, and fore and aft rollers which cooperate with the channel member for rollingly supporting the rail as well as guiding it. A pair of detachable rail supports 68, FIGS. 14 and 17, are more simply constructed and are used for the remote pair of the posts F.

Figures 15, 16, 17:
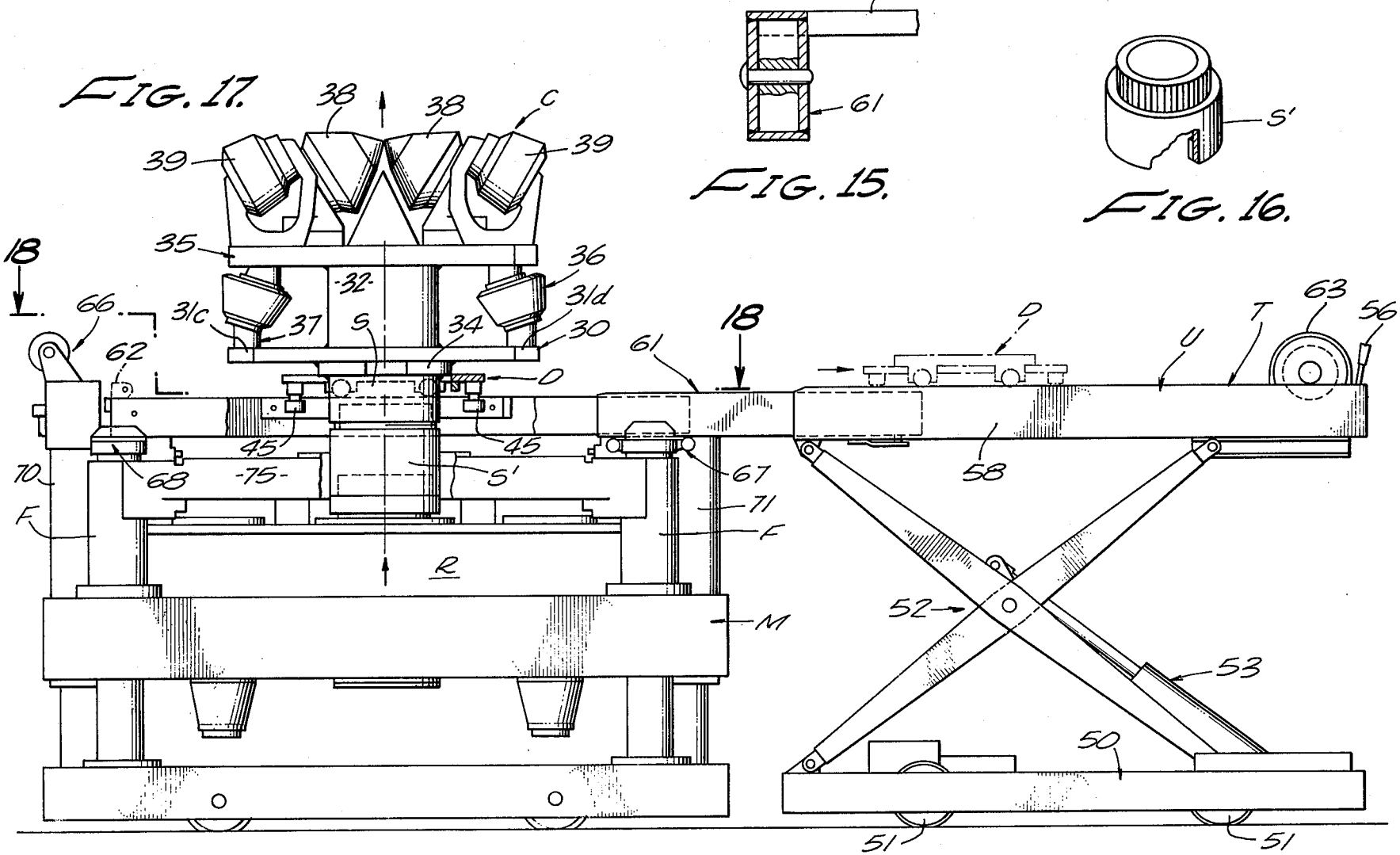
FIG. 15 is a fragmentary cross-sectional view taken on the line 15—15 of FIG. 14.
FIG. 16 is a perspective view of a special drill stem used in the transfer operation.
FIG. 17 is a side elevation view of the equipment similar to FIG. 14, showing the completed transfer of the cutterhead.
Figure 18:
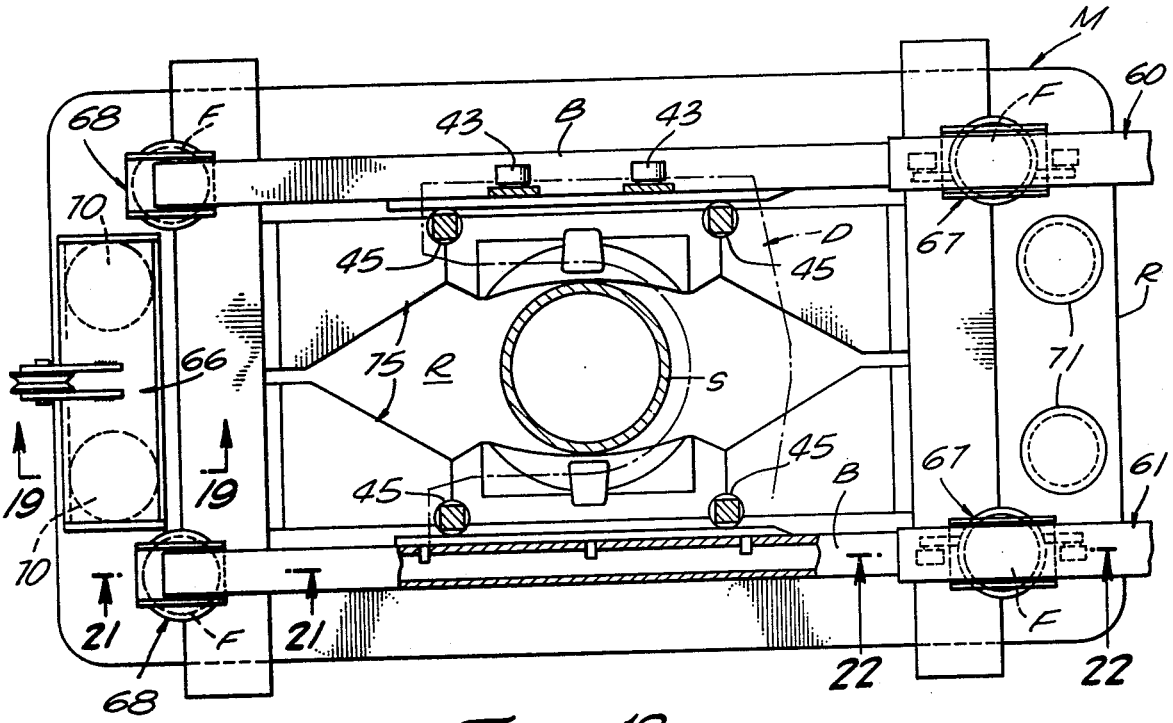
FIG. 18 is a plan view, partially in cross-section, taken on the line 18—18 of FIG. 17.
Figure 19:
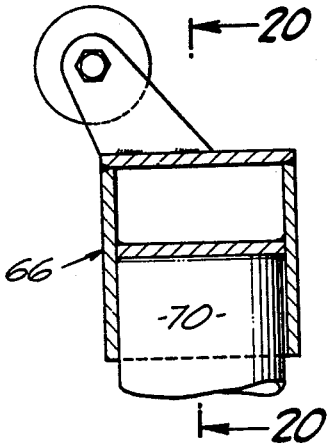
FIG. 19 is a fragmentary cross-sectional view taken on the line 19—19 of FIG. 18.
Figure 23:
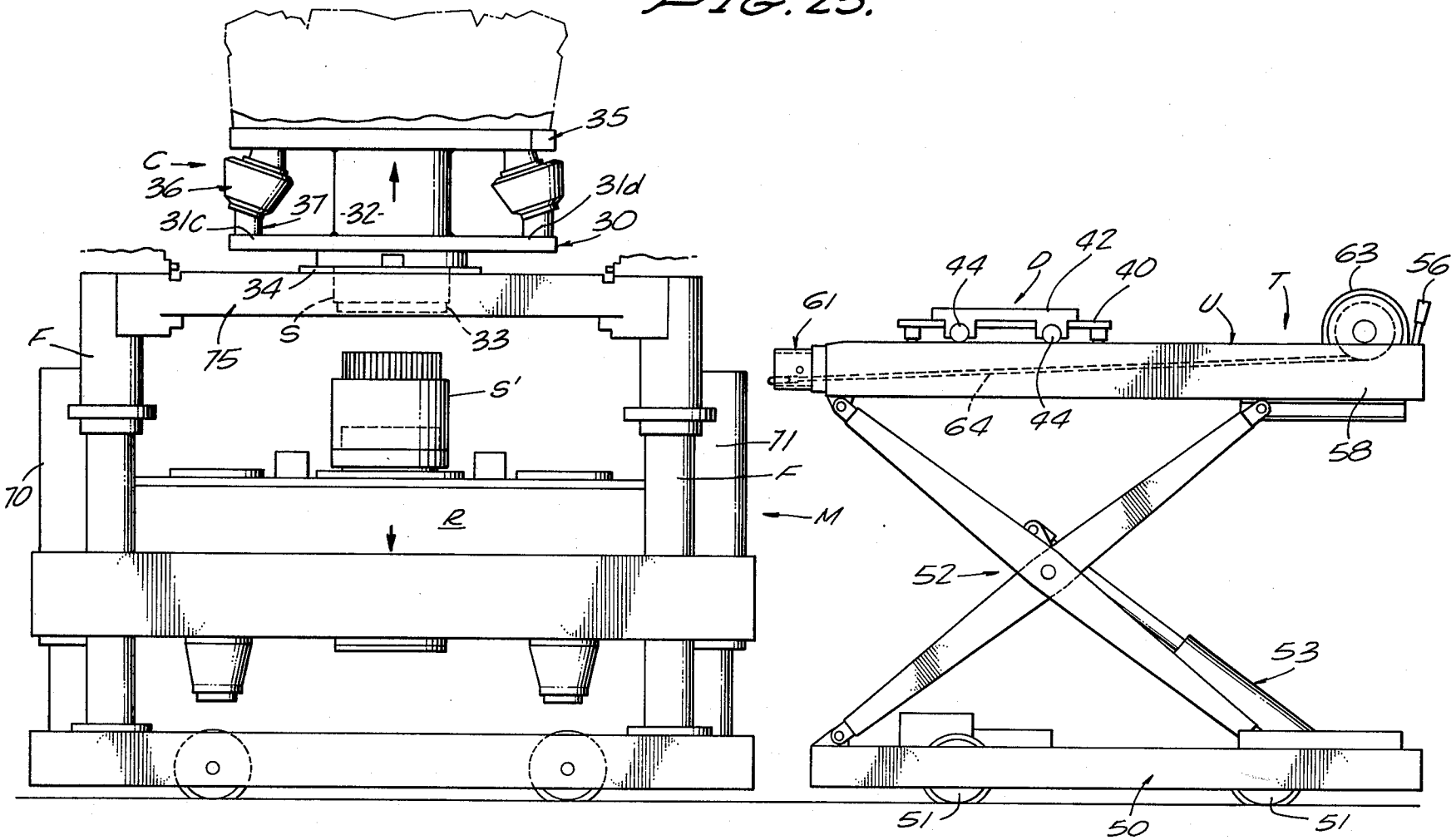
FIG. 23 is a side elevation view similar to FIG. 17, but showing the cutterhead in its operative position on the box hole machine, and the cutterhead transport car being disengaged from the machine.

Machine M includes a hair pin assembly 75, FIGS. 17 and 23, which rides up and down on the corner post F. The structure and operation of machine M are described in some detail in the copending application of Daniel R. Webb et al. Ser. No. 551,083, filed Feb. 20, 1975 and assigned to the same assignee as this present application. As explained in detail in the Webb et al application, the purpose of hair pin assembly 75 is to grasp the drill stem that supports the cutterhead during the times when rotary table is being either raised or lowered for the purpose of either inserting or removing another section of the drill stem.

Machine M also includes a pair of hydraulic ram cylinders 70 and a pair of hydraulic ram cylinders 71 which are used for the purpose of driving rotary table R either upward or downward. Rams 71 are located at the near end of the machine relative to transport car T while rams 70 are located at the far end.

When cutterhead C is to be installed on machine M, then as shown in FIG. 17 both rotary table R and hair pin assembly 75 are in their lower positions. The upper extremities of corner posts F are then exposed, making possible the attachment of the pair of rail guides 67 to the near posts and the pair of rail supports 68 to the far posts. At the same time a winch pulley 66 is removably attached to the rams 70 at the far end of the machine.

When the cutterhead C is first installed upon machine M the special drive stem S', FIG. 16, is attached to rotary table R. After installation of the cutterhead, however, the hair pin assembly is used to support the cutterhead in an elevated position as shown in FIG. 23. Drive stem S', which is of less than standard length, is then removed from the rotary table and a stem section of standard length is inserted in its place. Thereafter the cutterhead may be progressively elevated as the boring operation progresses, and additional sections of drive stem may be added, all in the manner described in detail in the Webb application.

METHOD OF USE

The novel method of the present invention has been generally described in conjunction with FIGS. 1(*a*) through 1(*g*), inclusive. More specifically, however, in location 21, FIG. 1(*f*), cutterhead C is placed upon dolly D with the base plate 30 of the cutterhead assuming an interfitting relationship with the bed 40 of the dolly. Pins 47 are inserted in order to secure the base plate to the dolly. Stem S of the cutterhead then extends downwardly through the central opening of the dolly bed 40 and to an elevation that is significantly below the wheel pairs 43, 44 of the dolly. The dolly with cutterhead thereon is placed upon the upper bed U of transport car T and is secured in position by tying it with rope or cable or other suitable means. Transport car T is then moved to location 22.

In location 22 the lift control 55 is actuated for energizing the drive cylinders 53 which in turn cause the scissors lift mechanism 52 to raise the upper bed U of the transport car. Upper bed U is raised to its limit position, the location 23, where the scissors lift mechanism is locked in place.

Figure 20:
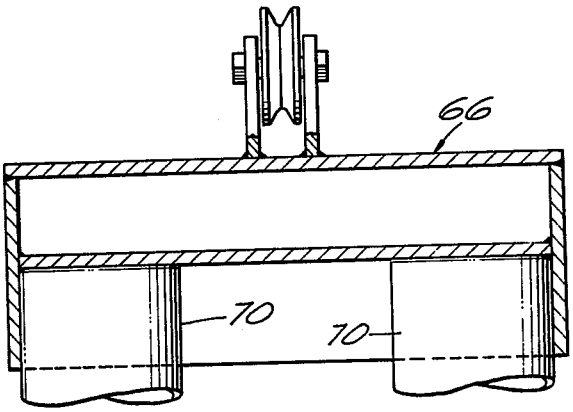
FIG. 20 is a fragmentary cross-sectional view taken on the line 20—20 of FIG. 19.
Figure 21:
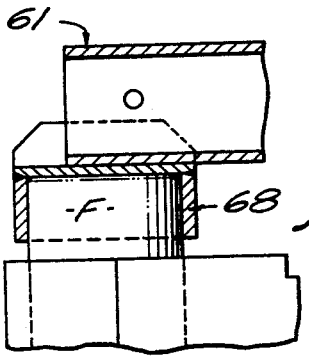
FIG. 21 is a fragmentary cross-sectional view taken on the line 21—21 of FIG. 18.
Figure 22:
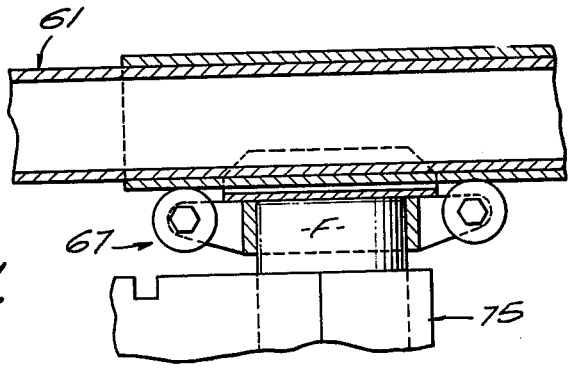
FIG. 22 is a fragmentary cross-sectional view taken on the line 22—22 of FIG. 18.

The machine M is then made ready for installation of the cutterhead by lowering the rotary table R as shown in FIG. 1(*f*), and by also lowering the hair pin assembly 75 as shown in FIG. 17. Rail guides 67 are attached to the exposed upper ends of the near pair of corner posts F. Rail supports 68 are attached to the exposed upper ends of the remote pair of posts F. The two supporting caps for winch pulley 66, FIG. 20, are attached to the remote pair of rams 70.

To complete the bridge the extensible rails 60, 61 must be extended. Cross-piece 62 is attached to the protruding ends of the extensible rails. Winch control 56 is operated to pay out the cable which is then pulled by hand around the winch pulley 66 and secured to cross-piece 62. The winch control is then actuated to pull in the cable which causes rails 60, 61 to be extended towards machine M and over and upon the guides 67 and support pieces 68.

The cable is then released from cross-piece 62, and is paid out sufficiently that it can be attached either directly to the dolly D or to the cutterhead C. At this time the rope or cable fastening the dolly in place upon the fixed rails 57, 58 of upper bed U of the transport car is released. Then the winch control 56 is again actuated to wind up the cable which results in pully the dolly with cutterhead thereon along the rail bridge. The dolly is positioned so that the depending stem S of the cutterhead is above, and aligned with, the drive stem S'.

At this time the rans 70, 71 are energized for raising rotary table R, and with it the drive stem S', but not the hair pin assembly 75. Drive stem S' passes laterally between the extended rails 60, 61, and at the same time passes through the central opening in bed 40 of the dolly. Drive stem S' is interengaged with and secured to the cutterhead stem S in the manner described in the Webb et al application.

In order to retract the temporary bridge B, it is then necessary to raise the rotary table somewhat further. Cross-piece 62 must be detached from the remote ends of the extensible rails 60, 61 because it cannot pass the drive stem assembly which now supports the cutterhead. The rails are partially retracted one at a time, using the winch and cable, and the cross-piece 62 is then reattached and the winch and cable is used in conjunction with the cross-piece for drawing the tubes or rails 60, 61 to their fully retracted position. The guides 67, support pieces 68, and winch pulley 66 are then removed from the machine M.

The invention has been described in considerable detail in order to comply with the patent laws by providing a full public disclosure of at least one of its forms. However, such detailed description is not intended in any way to limit the broad features or principles of the invention, or the scope of patent monopoly to be granted.

I claim:

1. The method of installing a cutterhead upon a box hole boring machine located within a horizontal drift of a mine comprising the steps of:

locating the cutterhead upon a movable transport means;

moving the transport means to a location within a predetermined distance from the boring machine;

positioning a rail bridge to extend from the transport means to an upper surface of the boring machine;

moving the cutterhead from the transport means, across the rail bridge, to a position above the boring machine so that the machine supports the entire weight of the cutterhead; and removing the cutterhead from the rail bridge by elevating the cutterhead by moving a portion of the boring machine between the rails of the rail bridge.

2. The method of claim 1 including the subsequent step of removing the bridge from the upper surface of the machine.

3. The method of claim 2 including the subsequent step of removing the transport means from the predetermined distance relative to the boring machine.

4. The method of claim 1 wherein said locating step includes the step of positioning a movable dolly on the transport means intermediate the latter and the cutterhead.

5. The method of claim 4 including the step of positioning the dolly upon a pair of extensible rails on the transport means; and said positioning step includes the step of extending the rail bridge from the transport means to the machine.

6. The method of claim 1 including the step of adjusting the elevation of the transport means after locating the cutterhead thereon and prior to positioning the rail bridge.

7. The method of attaching a cutterhead having a downwardly extending central stem to an upwardly extending drive stem of a box boring machine comprising the steps of:

locating the cutterhead upon a generally U-shaped dolly;

mounting the dolly upon a transport means;

extending a pair of rails between the transport means and the boring machine;

moving the dolly along the rails to a predetermined position relative to the boring machine; and passing the drive stem of the boring machine between the legs of the generally U-shaped dolly and thereby dislocating the cutterhead therefrom.

8. The method of claim 7 including the step of adjusting the vertical height of the transport means, thereby orienting the rails in a substantially horizontal plane between the upper portions of the transport means and the boring machine.

* * * * *